US006702493B2

(12) United States Patent
Sole et al.

(10) Patent No.: US 6,702,493 B2
(45) Date of Patent: Mar. 9, 2004

(54) PRINT MEDIA HANDLING APPARATUS

(75) Inventors: Macia Sole, Barcelona (ES); Lluis Hierro, Barcelona (ES); Xavier Alonso, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/773,117

(22) Filed: Jan. 31, 2001

(65) Prior Publication Data

US 2002/0102123 A1 Aug. 1, 2002

(51) Int. Cl.[7] ..... B41J 13/076; B41J 13/02
(52) U.S. Cl. ..... 400/641; 400/636
(58) Field of Search ..... 400/636, 641, 400/636.3, 637, 637.2, 637.3, 638, 639

(56) References Cited

U.S. PATENT DOCUMENTS 4,054,337 A * 10/1977 Matt et al. ..... 384/299
4,162,032 A * 7/1979 Lockwood ..... 226/81
4,214,740 A * 7/1980 Acquaviva ..... 271/134
5,530,459 A * 6/1996 Kline et al. ..... 346/136
5,775,823 A * 7/1998 Bekki et al. ..... 271/118
5,781,215 A * 7/1998 Onishi et al. ..... 346/135.1
5,800,076 A * 9/1998 Umeda ..... 400/645.3
5,818,487 A * 10/1998 Yoshimura et al. ..... 271/118
6,089,567 A * 7/2000 Yatsuhashi et al. ..... 271/188
6,190,070 B1 * 2/2001 Urban et al. ..... 271/188

FOREIGN PATENT DOCUMENTS

JP 57167219 A * 10/1982 ..... B29D/27/00
JP 08259029 A * 10/1996 ..... B65H/5/06
JP 09263348 A * 10/1997 ..... B65H/20/02
JP 09315616 A * 12/1997 ..... B65H/5/06
JP 10059577 A * 3/1998 ..... B65H/5/06
JP 2000351470 A * 12/2000 ..... B65H/5/06

OTHER PUBLICATIONS

Machine translation of JP 10–059577 from Japanese Patent Office website.*
Machine translation of JP 09–315616 from Japanese Patent Office website.*

* cited by examiner

*Primary Examiner*—Daniel J. Colilla
(74) *Attorney, Agent, or Firm*—Peter I. Lippman

(57) ABSTRACT

A print media handling device comprising a roller element having a rotational axis, the device being adapted to be mounted substantially coaxially between two adjacent pinch wheels of a ink jet apparatus such that in it is free to rotate about its rotational axis, the device being arranged in operation to limit the height of print media between said adjacent pinch wheels.

42 Claims, 8 Drawing Sheets

PRINT MEDIA HANDLING APPARATUS

TECHNICAL FIELD OF THE INVENTION

The present invention relates generally to inkjet apparatus, including inkjet printing mechanisms, and more particularly to an improved mechanism for avoiding print head crashes in such apparatus.

BACKGROUND OF THE INVENTION

Inkjet printing mechanisms may be used in a variety of different inkjet apparatus, such as plotters, facsimile machines, copiers, and inkjet printers collectively referred to in the following as printers, to print images using a colorant, referred to generally herein as "ink". These inkjet printing mechanisms use inkjet cartridges, often called "pens" or "print heads" to shoot drops of ink onto print media, which can be used in the form of cut sheets or rolls of print media, which may include paper, vinyl, films, canvas or the like, in a variety of different dimensions.

Some inkjet print mechanisms carry an ink cartridge with an entire supply of ink back and forth across the sheet. Other inkjet print mechanisms, known as "off-axis" systems, propel only a small ink supply with the print head carriage across the print zone, and store the main ink supply in a stationary reservoir, which is located "off-axis" from the path of print head travel. Typically, a flexible conduit or tubing is used to convey the ink from the off-axis main reservoir to the print head cartridge. In multi-color cartridges, several print heads and reservoirs are combined into a single unit, with each reservoir/print head combination for a given color also being referred to herein as a "pen".

Each pen has a nozzle plate that includes very small nozzles through which the ink drops are fired. The particular ink ejection mechanism within the print head may take on a variety of different forms known to those skilled in the art, such as those using piezo-electric or thermal print head technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor.

By selectively energizing the resistors as the print head moves across the sheet, the ink is expelled in a pattern on the print media to form a desired image (e.g., picture, chart or text). The nozzles are typically arranged in one or more linear arrays. If more than one, the two linear arrays are located generally side-by-side on the print head, parallel to one another, and substantially perpendicular to the scanning direction. Thus, the length of the nozzle arrays defines a print swath or band. That is, if all the nozzles of one array were continually fired as the print head made one complete traverse through the print zone, a band or swath of ink would appear on the sheet. The height of this band is known as the "swath height" of the pen, the maximum pattern of ink that can be laid down in a single pass.

For placing further print swaths on the print media, a print media feed mechanism is employed to advance or index the medium in the print zone in a second direction, called the media direction, which is usually substantially perpendicular to scanning direction of the print head.

Thus, to print an image, the print head is scanned back and forth across a print zone at a very close distance above the sheet, with the pen shooting drops of ink as it moves. On one hand, for instance, the distance between the printhead and the paper must be as small as possible, for example less than 1.7 mm, in order to obtain an accurate positioning of the ink dots projected from the printhead and to avoid spraying artefacts.

However, when a lot of ink is placed on some print media (especially on low cost paper based media) the print media may be subject to a phenomenon known as "cockle". In existing printers, cockle results from the print media swelling and expanding as it absorbs water contained in the ink, whilst the print media is simultaneously constrained against lateral expansion due to being gripped at given locations along the scan axis (i.e. along the axis of movement of the print head), between the pinch wheels and the main drive roller. Thus, the effect of wet cockle increases with the amount of ink deposited on the paper.

This results in the formation of undulations or wrinkles in the plane of the print media. As a consequence, the distance between the print media and the print head decreases at some localized points. This phenomenon is especially noticeable when printing area fills of more than 200%. By this it is meant that in a given area of print media, the amount of ink deposited during the printing operation is two or more times the quantity of ink that is required to cover that area. This problem is further exacerbated by high temperatures and high levels of humidity.

If the degree of cockle is particularly severe, a "bubble" in the media may form. If the height of the media bubble is sufficient, the plot may be damaged as ink on the plot is smeared by the print head. Indeed, in more severe cases, a media crash may occur as the print head impacts against the print media itself. A media crash may seriously affect the subsequent print quality or throughput of the printer due to damaging the operation of individual nozzles of the pen. In some cases a media crash may necessitate the replacement of the pen.

This problem is often of particular concern where a plot is printed on a single sheet of print media, where the problem may be particularly pronounced in the trailing edge, of the sheet of print media; i.e. the last area to be printed. This situation is illustrated schematically in FIG. 1. FIG. 1*a* illustrates a sheet of print media 10 during a print operation. The print media 10 is resting on a platen 400 as it is driven through a printer drive mechanism 30, consisting of a drive roller and opposing pinch wheels, in the direction indicated by the arrow. As can be seen from the figure, the media has expanded laterally, as indicated by arrows "A" after having passed through the print zone 40 and as a result of having absorbed the moisture in the ink deposited on it. However, where the media 10 is gripped between the drive roller and opposing pinch wheels of the printer drive mechanism 30 it is constrained against such lateral expansion. However, as can be seen from the figure, the edges of the print media 10 which have yet to pass through the printer drive mechanism 30 have a tendency to align themselves at the same angle as the edges of the print media 10 at the print zone side of the printer drive mechanism 30. In the figure, this is indicated by arrows "B". This has the effect of causing the edges of the print media 10 which have yet to pass through the printer drive mechanism to move towards each other, thus causing the raised zones, which together resemble a "wave" in the print media 10. The wave is indicated by arrow "C". The form of the wave is more clearly shown in FIG. 1*b* which is a cross sectional view of the print media shown in FIG. 1*a*, taken along lines X—X.

FIG. 2 illustrates a section of the printer drive mechanism 30 of FIG. 1, illustrating the interrelationship between the platen 400, the drive roller 300 and a series of pinch wheels 310 of the drive mechanism 30. As the print media (not shown) passes the drive roller 300 and the series of pinch wheels 310, it may retain the wave shape "C" that it had acquired, as shown in FIG. 1, where it is not constrained between the pinch wheels 310 and the main drive roller 300; i.e. at the locations 70. This results in the formation of media bubbles in these areas. With increased quantities of ink deposited on the sheet of print media 10, such media bubbles expand. This causes the height of the media bubbles to increase and so increasing the likelihood that the ink on the plot may be smeared by the print head, or that a media crash will occur, as has been described above.

The size and number of media bubbles may be reduced by increasing the proportion of the width of the print media (along the scan axis), which is constrained between the main drive roller and the pinch wheels. However, it has been observed that by doing so print media handling problems arise as a result of increased stresses building up in the print media.

This problem may be partially or wholly overcome by using print media that is not susceptible to cockle, or by constraining the print media in the lateral sense in the area before entry into the print drive mechanism. For example, by using a roll fed print media with back tensioning force, the media tends to keep flatter on the platen. Thus, the development of the wave "C" is inhibited to a certain extent. However, depending upon the operating conditions, this problem still occurs with such an arrangement. Alternatively, the print media may be entrained around the main drive roller; i.e. using a high "wrap angle". This inhibits the development of the wave "C" more effectively. However, such solutions are clearly not appropriate to all designs of printer or modes of operating them. For example, the use of a wrap angle prevents the printer from being used with non-flexible print media.

Another known approach to addressing this problem uses "skis" or "guides" located between the pinch wheels of the drive mechanism that force any media bubbles between adjacent pinch wheels to flatten as the print media passes between the pinch wheels and the main drive roller. These "skis" or "guides" consist of planar guide surface located between adjacent pinch wheels. Each ski is angled to progressively flatten a media bubble as it advances towards the pinch wheels. In this way, the available space for a media bubble to exist in decreases as the media bubble approaches the pinch wheels, until the point where the media bubble is limited to a height less than that which is likely to cause a media crash.

However, this solution suffers from several disadvantages. Firstly, the print media is sometimes damaged where it comes in to contact with the skis. This problem is particularly noticeable when the print media is glossy or has another surface which is susceptible to surface damage or where such damage is readily noticed. Secondly, in order to effectively limit the height of any media bubbles that have formed, known skis tend to substantially fill the area between adjacent pinch wheels. This has the effect of obstructing the leading edge of a new sheet of print media from the point of view of the user when it is being introduced between the pinch wheels and the main drive roller prior to printing. Furthermore, any sheet alignment marks or lines provided on the printer platen to help the user to correctly introduce a new sheet may also be obstructed from the view of the user by the skis. Thus, the provision of such skis in a printer may make it difficult for the user to ensure that the new sheet of print media is introduced correctly.

SUMMARY OF THE INVENTION

In view of the foregoing, it is an object of the present invention to provide an improved inkjet apparatus.

A further object of the invention is to provide an inkjet apparatus for reducing the likelihood of a print head crashes, particularly when printing on pre-cut sheets of print media.

Still another object of the present invention is to provide an inkjet apparatus for reducing the damage to prints in which media bubbles have developed as it is handled by the drive mechanism of a printer.

To achieve these objects, there is provided an inkjet apparatus in which there is a reduced likelihood of a media crash occurring when media bubbles have developed. According to the present invention there is provided an ink jet apparatus having a print media feed path and a print media feed assembly, said feed assembly being arranged to feed print media having a width and a length in the direction of said media length along said feed path, said feed assembly including: a print media drive roller having a rotational axis extending substantially transverse to said feed path; first and second pinch wheels to rotatably cooperate with said drive roller so as to grip said media therebetween, and being further arranged to grip said media at a first and second respective locations spaced apart along said media width; and, a roller element being arranged to rotate about a rotational axis substantially parallel to said drive roller rotational axis, the roller element being located at a third location along said media width, said third location being substantially between said first and said second locations, the roller element being arranged to limit the height of said media in the region of the third location.

The inter-pinch wheel arrangement of the present invention provides a means of allowing the print media to expand in a controlled manner. Thus, by controlling the height to which a media bubble may grow, the situation where the print head may come into contact with the ink already deposited on the surface of the print media, or the print media itself, may be avoided. Additionally, by allowing the print media to expand in a controlled manner, the stresses induced in print media as a result of the absorption of fluid from ink deposited on it are reduced. Thus, the paper handling difficulties are avoided.

Furthermore since the inter-pinch wheel of the present invention is able to rotate about its axis when it is contacted by a media bubble, negligible relative movement between the surface of the inter-pinch wheel in contact with the print media and the print media itself arises. This aspect of the inter-pinch wheel of the present invention greatly reduces the likelihood of damaging the surface of the print media in which a media bubble has formed. The fact that the inter-pinch wheels of the present invention are free to rotate in the sense of the media advance also allows them to be relatively small in comparison to a ski, whilst being able to adequately control media bubble growth without damaging the media surface. This means that an operator of a printer equipped with inter-pinch wheels of the present invention is able to clearly see any alignment marks on the platen of the printer that facilitate the loading of the new sheets or rolls of print media onto the printer.

Preferably, inter-pinch wheels of the present invention have an undulating profile. This allows a greater degree of media expansion whilst effectively limiting the height of the media bubble than is the case with skis, which due to their comparative difficulty of construction and mode of operation have been used with a flat profile.

Preferably, the inter-pinch wheels of the present invention are manufactured in an injection molding process from a plastics material. Therefore, they benefit from being simple and cost effective to manufacture.

Preferably, the inter-pinch wheel of the present invention is mounted in a "snap fit" manner (i.e. pressed into place) on stub axles protruding from adjacent pinch wheels. Therefore, they may be accurately positioned in a simple and cost effective manner.

BRIEF DESCRIPTION OF THE DRAWINGS

For a better understanding of the invention and to show how the same may be carried into effect, there will now be described by way of example only specific embodiments according to the present invention with reference to the accompanying drawings, wherein.

DETAILED DESCRIPTION OF THE PREFERRED EMBODIMENT

Figure 1A:
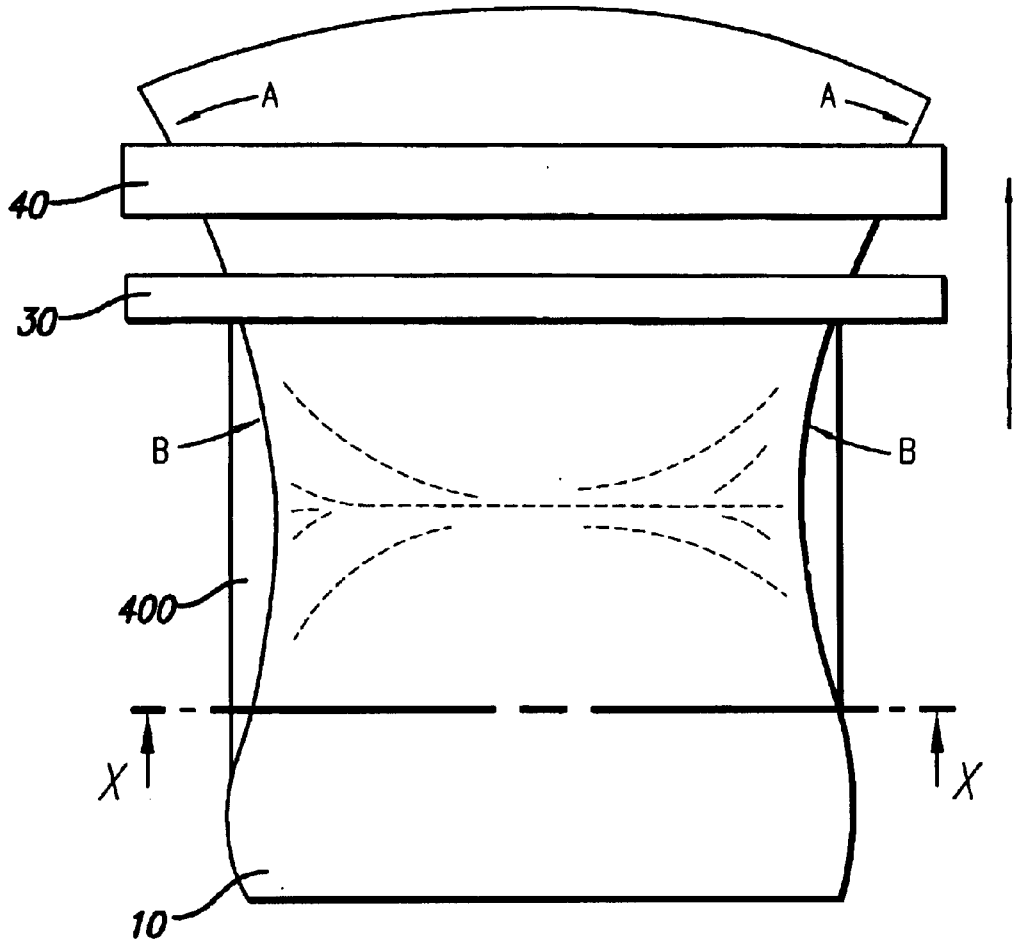
FIG. 1A PRIOR ART
FIG. 1*a* is a schematic plan view of a single print media sheet exhibiting a wave type deformation during a printing operation.

There will now be described by way of example only the best mode contemplated by the inventors for carrying out the invention Referring to FIG. 3, a printer 110 incorporating the advantages of the present invention is shown. Although certain aspects of the printer 110 do not form part of the present invention they are nevertheless described briefly below in for the purposes of clearly describing the invention.

The printer 110 includes a housing 112 mounted on a stand 114. The housing has left and right drive mechanism enclosures 116 and 118. A control panel 120 is mounted on the right enclosure 118. A carriage assembly 100 illustrated in phantom line under a cover 122, is adapted for reciprocal motion along a carriage bar 124, also shown in phantom line. The carriage assembly 100 comprises four inkjet print heads 102, 104, 106, 108 that store ink of different colors, e.g. black, magenta, cyan and yellow ink respectively, and an optical sensor 125. The inkjet print heads 102, 104, 106, 108, are held rigidly in the movable carriage 100 so that the print head nozzles scan above the surface of the medium 130 in a controlled manner with the carriage assembly 100.

The position of the carriage assembly 100 in the horizontal, or carriage scan axis (Y-axis), direction is determined by a carriage positioning mechanism (not shown) with respect to an encoder strip (not shown).

As the carriage assembly 100 translates relative to the medium 130 along the X and Y axes, selected nozzles of the print heads 102, 104, 106, 108 are activated and dots of ink are deposited in the desired pattern on the print media 130, having two edges 131, and 132. The ink dots deposited on the print media are mixed as and where required in order to obtain the desired color.

The print media 130, such as paper, is in this embodiment in the form of a precut sheet.

Figure 3:
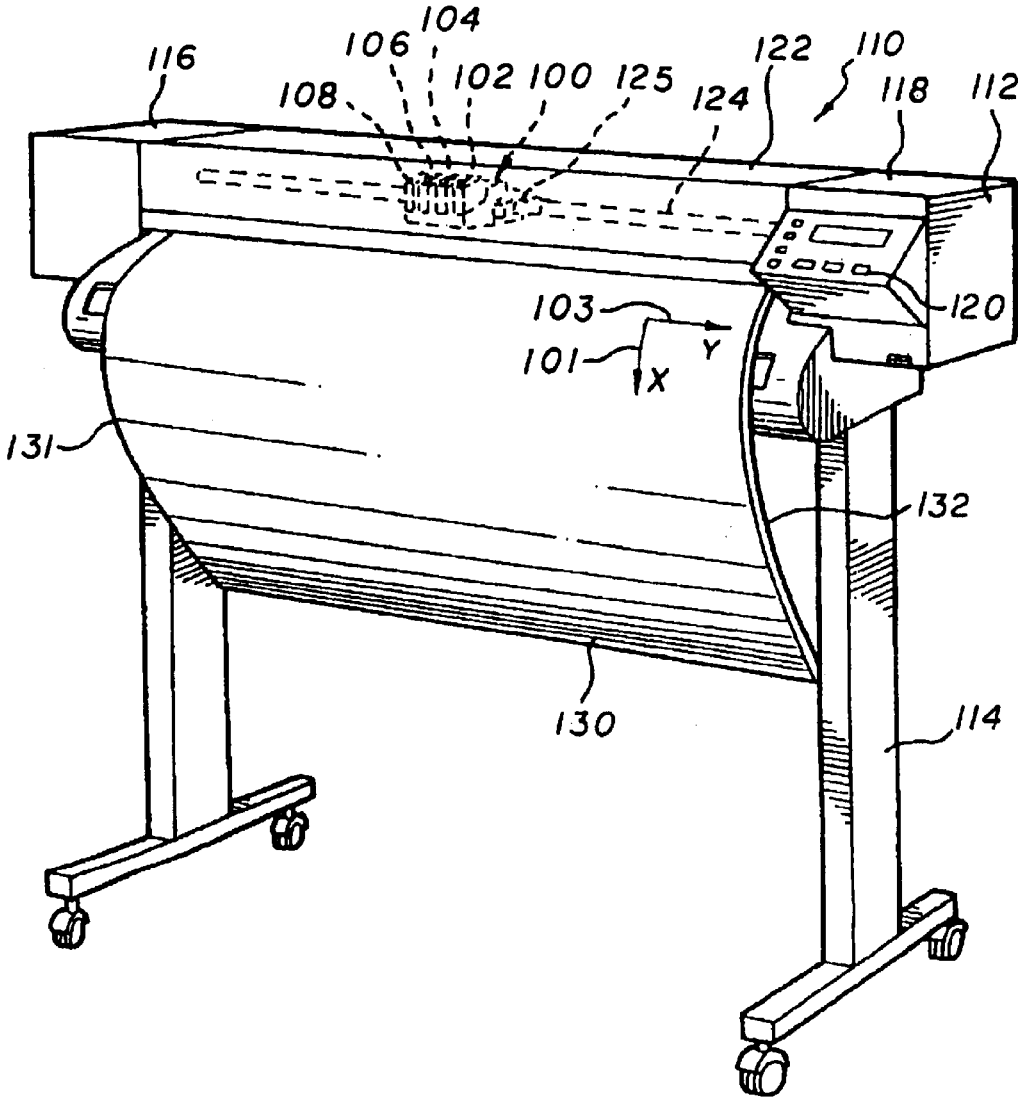
FIG. 3 is a perspective view of an inkjet printer according to an embodiment of the invention.
Figure 4:
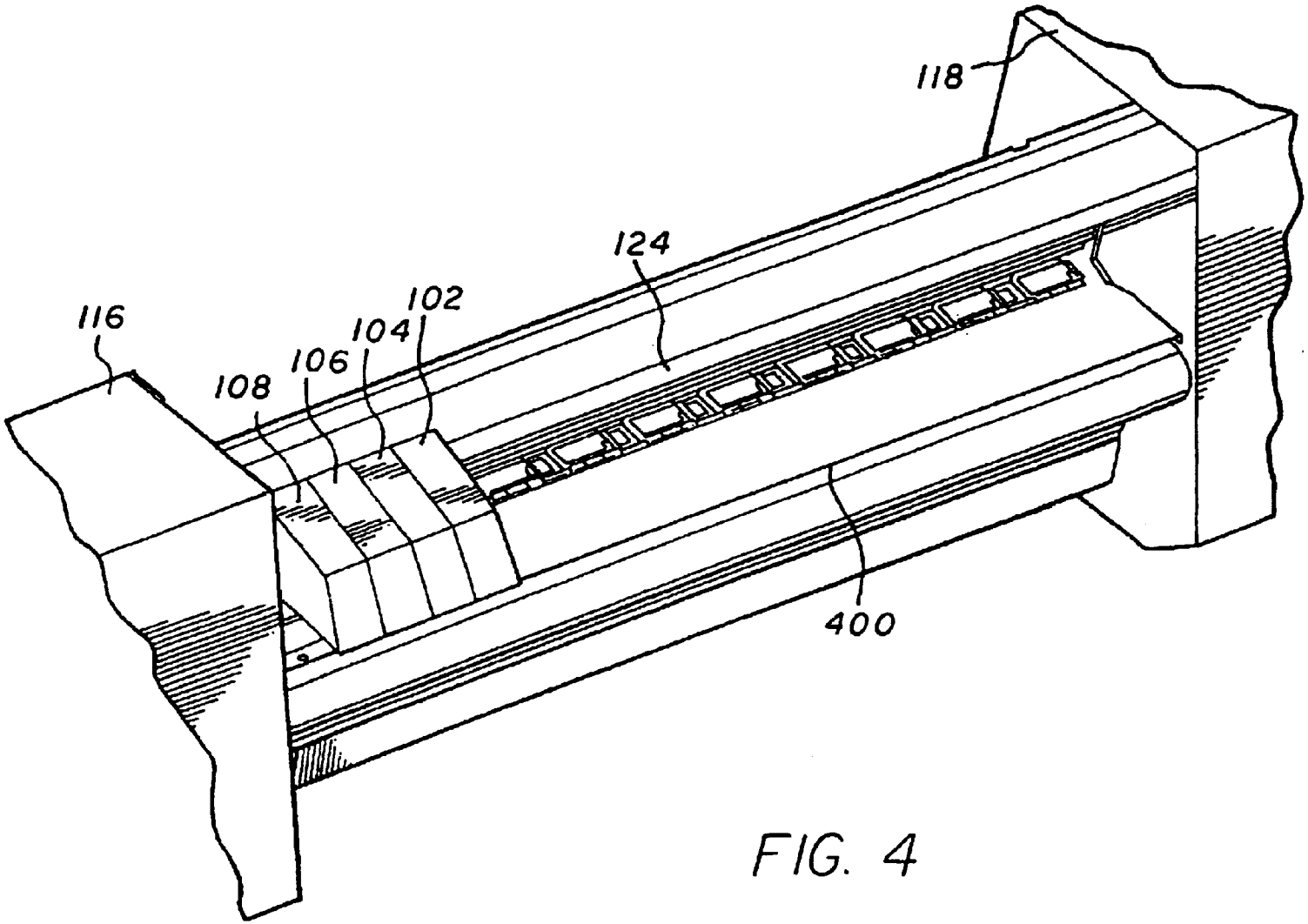
FIG. 4 is a more detailed diagram of a portion of the printer of FIG. 3.

Referring now to FIG. 4, a more detailed view of part of the printer 110 shown in FIG. 3 is shown. A flat stationary support platen 400 is located between the left and right drive mechanism enclosures 116 and 118. The width of the platen 400 along the Y-axis, or scan axis, is at least equal to the maximum allowable width of the print media. In this example it should allow the employment of media having width up to 36 inches, i.e. 914 mm. The platen 400 is arranged to support the print media such that it is substantially flat when lying underneath the carriage assembly, as the carriage assembly translates along the carriage bar during a printing operation.

Figure 2:
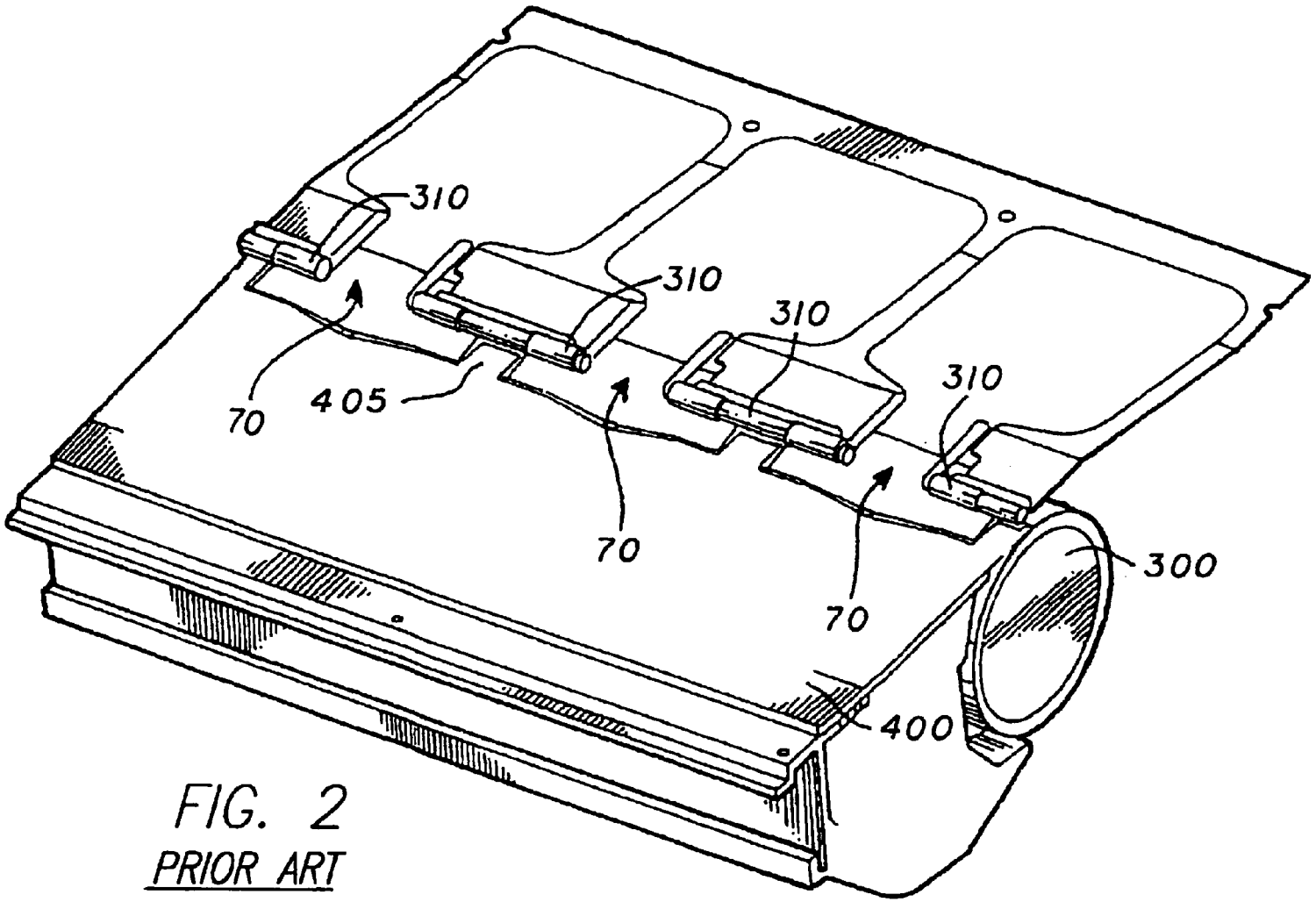
FIG. 2 PRIOR ART
FIG. 2 shows part of the drive mechanism of a prior art printer.
Figure 5A:
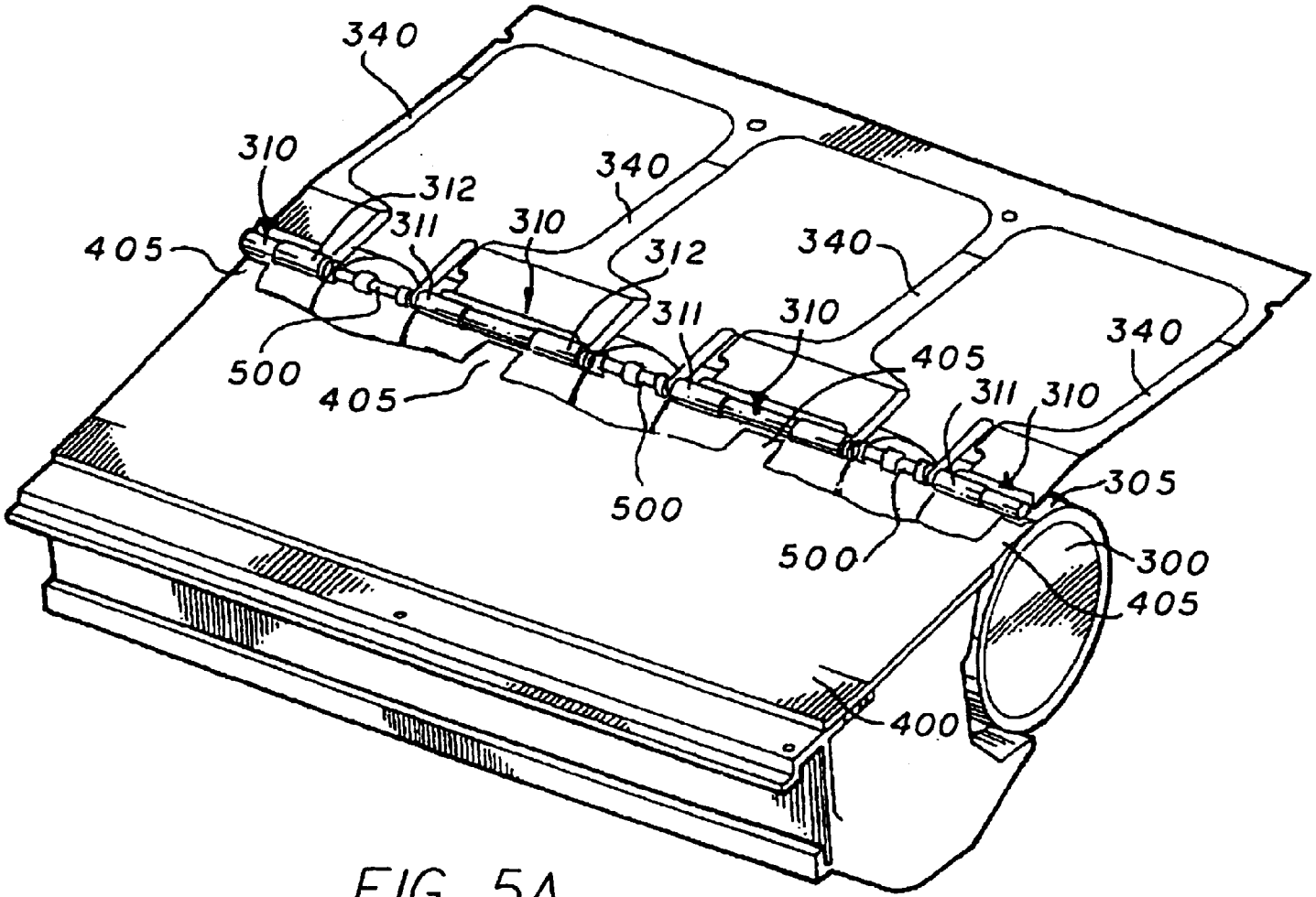
FIG. 5*a* depicts a detailed partial view of the media drive components of the printer of FIG. 3.
Figure 5B:
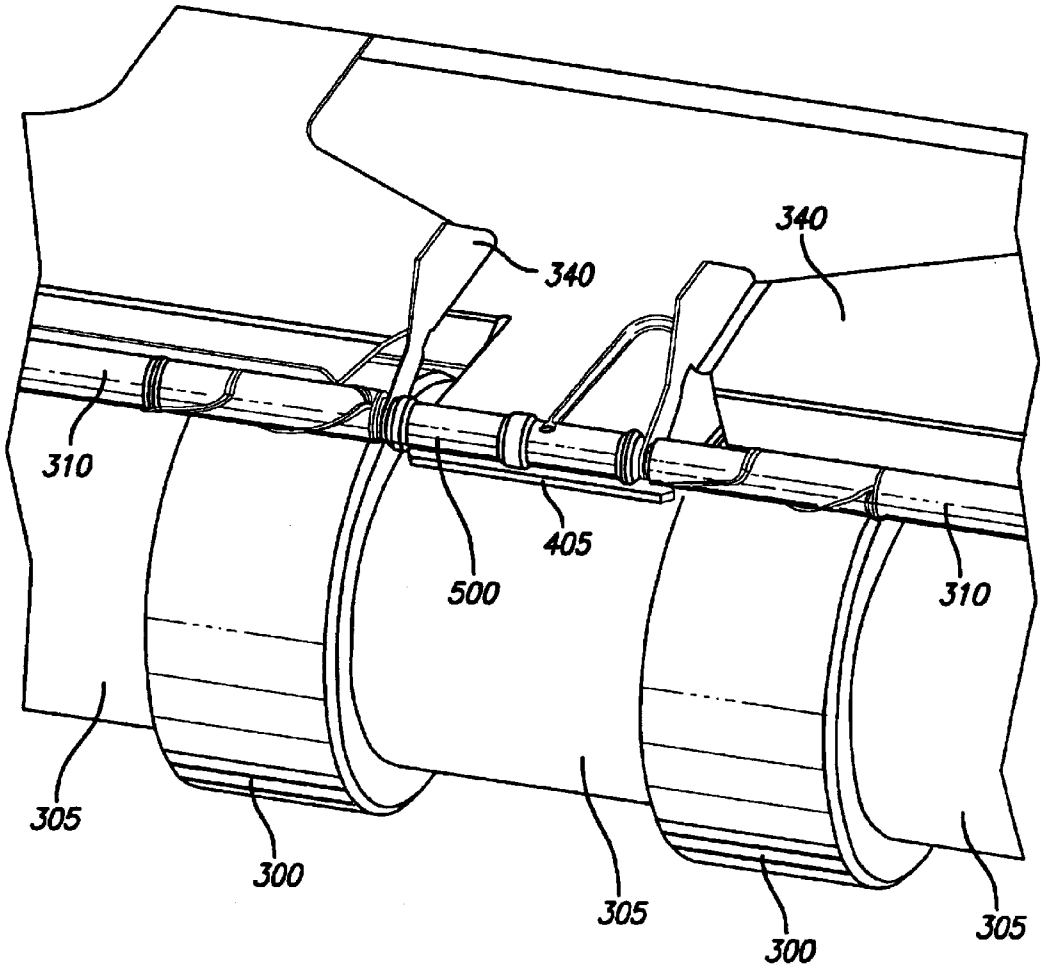
FIG. 5*b* shows an enlarged, reverse angle view of the mounting arrangement of one inter-pinch wheel according to an embodiment of the invention.

Part of the drive mechanism of the printer including an inter-pinch wheel of the present embodiment, is shown in FIG. 5*a*. Additionally, an enlarged view of the mounting arrangement of one inter-pinch wheel according to the present embodiment is shown in FIG. 5*b*. This figure is shown from the reverse angle to that of FIG. 5*a*; i.e. looking from the rear of the printer. FIGS. 5*a* and 5*b* both show the inter-relationship between the inter-pinch wheels 500, the platen 400, the main drive roller 300, the pinch wheels 310, and the pinch wheel spring mountings springs 340 in the present embodiment. Each of the platen 400, the pinch wheels 310, the pinch wheel mountings springs 340 correspond, in general terms, to the equivalent structure of the prior art printer shown in FIG. 2. Therefore, they are referred to by equivalent numerals and their structure and function will be described here only briefly.

As is shown in both FIGS. 5*a* and 5*b*, the platen 400 is provided with a plurality of protrusions 405 extending towards the rear of the printer 110. The protrusions 405 are located in corresponding circumferential recesses 305, in the otherwise conventional surface of the main roller 300. This arrangement allows the medium 130 to reliably move from the main roller 300 to the platen 400 and vice versa as it is fed during a media feed or printing operation. The skilled reader will appreciate that a gap or a step between the main roller 300 and the platen 400 may allow an edge of the print media to engage the edge or underside of the platen, instead of the upper surface of the platen, causing a paper jam.

In this example 10 pinch wheels 310, also known as pinch rollers, are arranged, spaced along scan axis 103 of the printer, above the main roller 300.

Each of the pinch wheels 310 is formed from two cylindrical end segments 311 and 312, which preferably have substantially the same length. The end segments 311, 312 are joined by a third central cylindrical segment 313 having a longer length and a smaller diameter than the two end segments, preferably of about 5 mm. The end segments 311 and 312 are arranged to contact with the print medium, whilst the central segments 313, due to its reduced diameter, is arranged not touch with the print media.

A plurality of springs 340 are arranged to generate a contact force between each pinch wheel 310 and the main roller 300. In the present embodiment, this force is preferably between 3.33 N and 5 N, more preferably 4.15 N. The distribution and force of the pinch wheels 310 help to ensure that the print medium 130 is driven straight during printing, with negligible lateral slippage. The main roller 300 is preferably made of a relatively soft material such as rubber, to increase the friction with the print medium, while the pinch wheels are made of a harder material such as plastic.

As is shown in the figure, the inter-pinch wheel 500 of the present embodiment is shown to be mounted between adjacent pinch wheels 310 of the printer drive mechanism. In the preferred embodiment, each inter-pinch wheel 500 consists of a single, low cost, injection-moulded part, manufactured from a plastics material. In the present embodiment, the material is preferably polycarbonate, incorporating 20% glass fiber and 15% PTFE. The addition of glass fiber and PTFE help, respectively, to increase the stiffness and reduce the friction properties of the inter-pinch wheel.

Figure 6:
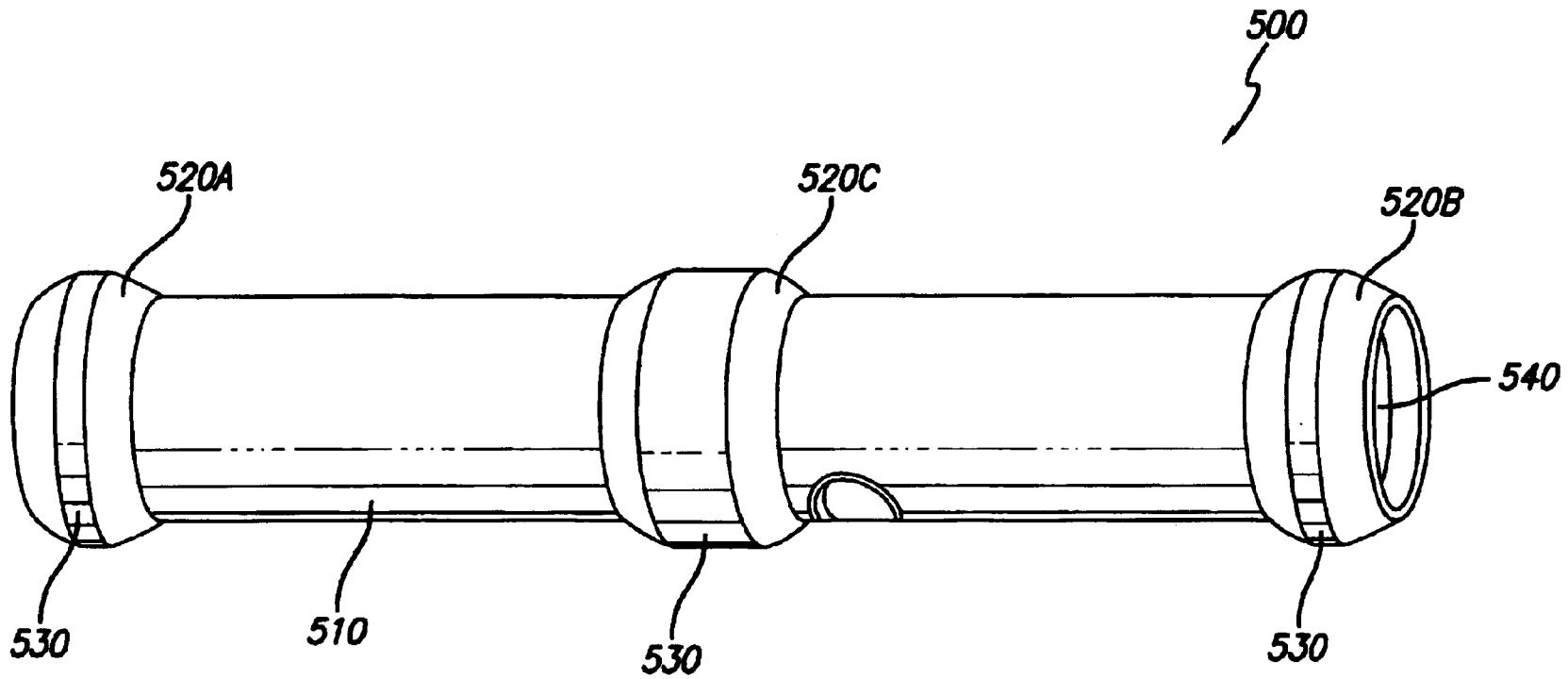
FIG. 6 is an isometric view of inter-pinch wheel according to an embodiment of the invention; and, FIGS. 7*a–c* illustrates the operation of an inter-pinch wheel of an embodiment of the invention.

FIG. 6 shows an isometric view of the inter-pinch wheel 500, which consists of a central axle 510, of circular cross-section, with three areas of increased radius; one positioned at each end of the axle, referenced 520*a* and 520*b*, and one positioned centrally along the length of the central axle 520*c*. Each of these areas of increased radius has an outer diameter which forms a tread 530 for engaging print media that has expanded to a moderate degree during a printing operation, as is described below. Between the areas of increased radius are areas of reduced radius that are arranged to allow for further expansion of the print media as media bubbles grow, as is also described below. In the preferred embodiment, the length of the inter-pinch wheel is 30 mm and its diameter is approximately 6 mm in the regions of increased diameter and is 5 mm in the regions reduced diameter. The greater diameter, 6 mm, of the inter-pinch wheel 500 corresponds approximately to the diameter of the end segments 311 and 312 of the pinch wheels 310. The Applicant has found, in the preferred embodiment of the invention, that the preferred maximum radius of the inter-pinch wheels 500 should be approximately 0.4 mm less than that of the pinch wheels 310, thus providing space into which cockled media may expand. However, in the present embodiment, the precise diameter of the inter-pinch wheels 500 is not critical since each of the inter-pinch wheels 500 are located opposite the circumferential recesses 305 in the main roller 300, as can be seen from FIG. 5*b*. However, the skilled reader will appreciate that the present invention could equally be applied to an ink jet apparatus in which no such circumferential recesses 305 in the drive roller 300 exist.

At either end of the inter-pinch wheel 500, a centrally positioned axle mounting point 540 is located, which is shown at one end only in the figure. These allow each inter-pinch wheel 500 to be supported co-axially with, and between adjacent pinch wheels, on mounting studs (not shown) associated with the adjacent pinch wheels 310, as is shown in FIGS. 5*a* and 5*b*. In the preferred embodiment, neither the inter-pinch wheels 500 nor the pinch wheels 310 are positively driven. Thus, the forces acting on the inter-pinch wheels 500 during operation are low. Therefore, as the skilled reader will appreciate, no bearings are required when using a material such as polycarbonate.

The fit between each mounting stud of an adjacent pinch wheel 310 and the corresponding axle mounting point 540 of the inter-pinch wheel 500 is a loose fit. Therefore, the inter-pinch wheels 500 are free to rotate freely around their longitudinal axes independently of the adjacent pinch wheels 310. Thus, they may rotate at a different angular velocity to the adjacent pinch wheels 310, as determined by the difference in their respective radii, when contacting a print media bubble. The loose fit of the inter-pinch wheels 500 also allows a user to mount, or removed the inter-pinch wheels 500 simply and quickly as and when required, whilst the pinch wheel assemblies (i.e. pinch wheels and the springs supporting the pinch wheels) are already in position. This is facilitated by the fact that the inter-pinch wheels 500 of the present embodiment may be simply "pressed" into position without the need for tooling or special assembly procedures.

The loose fit of the inter-pinch wheels 500 also avoids the problem of overly constraining the independent movement each pinch wheel 310, on its independent mounting spring 340. Thus, because of the comparatively loose fit, reasonable independent movement of each pinch wheel 310 is possible despite the presence of the adjacent inter-pinch wheels 500.

However, the fit is tight enough to ensure that the inter-pinch wheels 500 are not dislodged from their mountings during a printing process by the formation of a media bubble. The exact fit required depends upon various factors including: the type of print media being used; the amount of ink deposited on the media; the speed of the printing process; the height of the pen above the media; and, the spacing between the pinch rollers. Thus, the required fit for any given application may be found by experimentation.

Typically, a large format printer has ten pinch wheels 310 spaced at equal intervals along the scan direction, i.e. perpendicular to the direction of medium advance. Thus in this example, a total of nine inter-pinch wheels are used, each one positioned between two adjacent pinch-wheels 310. However, in practice, inter-pinch wheels 500 according to the present embodiment may be used only between those pinch wheels 310 where required. For example, as has been explained above, the wave effect is more pronounced at the edges than in the middle of the print media. Thus, for a given situation, it may be found that inter-pinch wheels 500 are required only between those pinch wheels 310 located at the edges of the scan axis. Thus, it may not be required to install inter-pinch wheels 500 between certain pinch wheels 310 located centrally along the scan axis. Again, the number and position of the inter-pinch wheels 500 required may be found by experimentation.

Figure 7A:
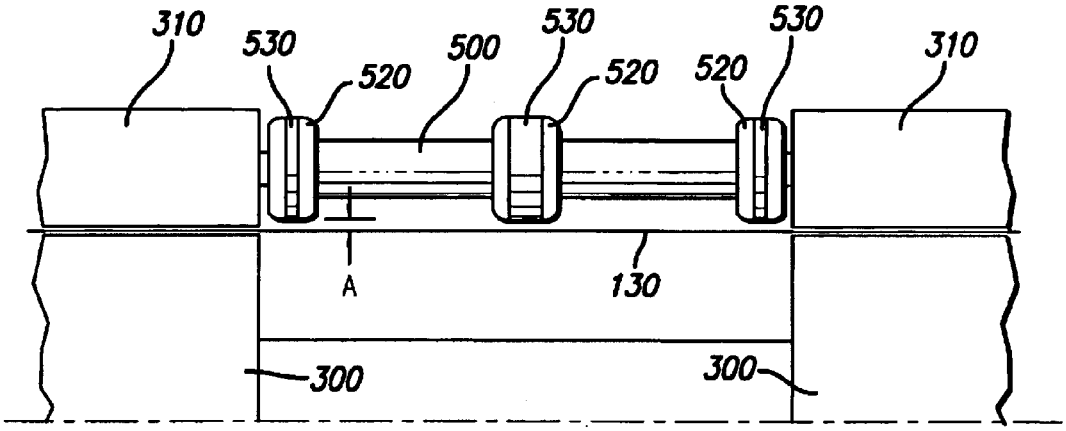

The operation of the printer of the present embodiment, including the action of the inter-pinch wheels 500 during the operation of the printer will now be described with respect to FIGS. 7*a–c*, in which it is schematically illustrated.

When the operator introduces a new sheet of print media 130 into the printer drive mechanism and lowers the pinch wheels 310 to grip the sheet of print media, but prior to the start of the printing operation, the sheet of print media lies flat between the drive roller 300 and the pinch wheels 310. This situation is shown in FIG. 7*a* for a representative portion of the drive mechanism of the printer of the present embodiment. As can be seen from the figure, the print media sheet 130 is gripped between the segments of the drive roller 300 and the opposing pinch wheels 310. However, since the maximum radius of the inter-pinch wheels 500 is approximately 0.4 mm less than that of the pinch wheels 310 and is co-axially mounted with the pinch wheels 310, a small gap, referenced by arrows "A", exists between the upper surface of the sheet of print media 130 and the tread 530 of the areas of increased radius 520 of the inter-pinch wheels 500. Thus, whilst the print media sheet 130 remains flat, i.e. before the formation of any cockle or media bubbles, the inter-pinch wheels 500 do not generally contact the sheet of print media 130.

During a printing operation, the print media 130 passes between the main roller 300 and the pinch wheels 310. The main driving roller 300 is controlled to rotate by the printer control unit (not shown) to periodically index or convey the medium across the surface of the platen 400 in a stepwise manner in the print media feed direction (X axis shown in FIG. 3). In operation, the printer carries out the process of printing a plot in a standard manner as is well known to the skilled reader, using any suitable print mode may be used to create the plot. For example, the each desired swath may be printed in a single pass of the carriage 100 or in several passes, as is used in higher quality printing, before the paper advances the full length of the print zone.

Figure 1B:
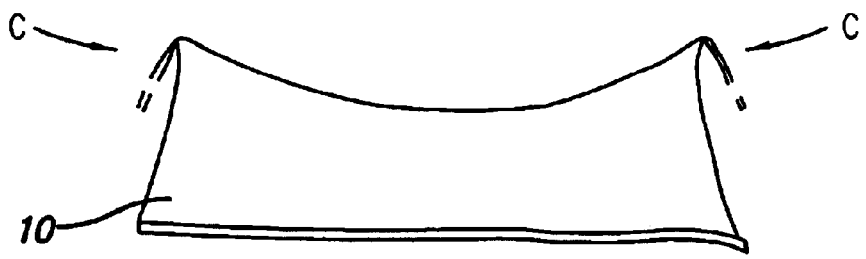
FIG. 1B PRIOR ART
FIG. 1*b* is schematic cross sectional view of the single print media sheet shown in FIG. 1*a;*

After the printing process has commenced, a wave may form in the print media 130 prior to passing through the printer drive mechanism, as described above with reference to FIG. 1. Once such a wave has developed the sheet of print media 130 will continue to lie flat where it is constrained between the drive roller 300 and the pinch wheels 130. However, where, the sheet is not constrained between the drive roller 300 and the pinch wheels 130, the media sheet 130 may retain the shape of the wave. As has been stated above, this is especially likely to happen where large quantities of ink are deposited on the media, thus reducing its inherent rigidity.

As can be seen from the figure, a media bubble 710 has formed in the zone underlying the inter-pinch wheel 500. However, since the print media 130 is only free to expand in to the space available under the inter-pinch wheel 500, instead of a single media bubble forming, two smaller, adjacent media bubbles 710*a* and 710*b* form between the areas of increased radius on the inter-pinch wheel 500; i.e. between the areas of increased radius 520*a* and 520*c* and between areas of increased radius 520*b* and 520*c*. Thus, the height of each media bubble 710*a* and 710*b* is significantly reduced compared to the height that a single media bubble in the same circumstances would reach, if the inter-pinch wheel 500 were not present; i.e. if the print media 130 were allowed to expand in its free, or unconstrained shape. With this reduction of height of the media bubbles, the risk of contact of the print media 130 with the printheads is significantly reduced. However, since the print media 130 is allowed to expand in a controlled manner, the stresses that build up in the swollen print media 130 are relieved, thus increasing the ease with which the print media may be handled.

As the print media 130 is advanced, in either a positive or a negative direction during a printing or print media feed operation, the friction between the print media and the inter-pinch wheel 500 causes the inter-pinch wheel to rotate. This results in there being negligible relative movement between the surface of the inter-pinch wheel 500, which is in contact with the print media 130 and the print media 130 itself. Thus, the possibility of the inter-pinch wheel 500 scratching or otherwise damaging the surface of the print media 130 is significantly reduced.

Figure 7B:
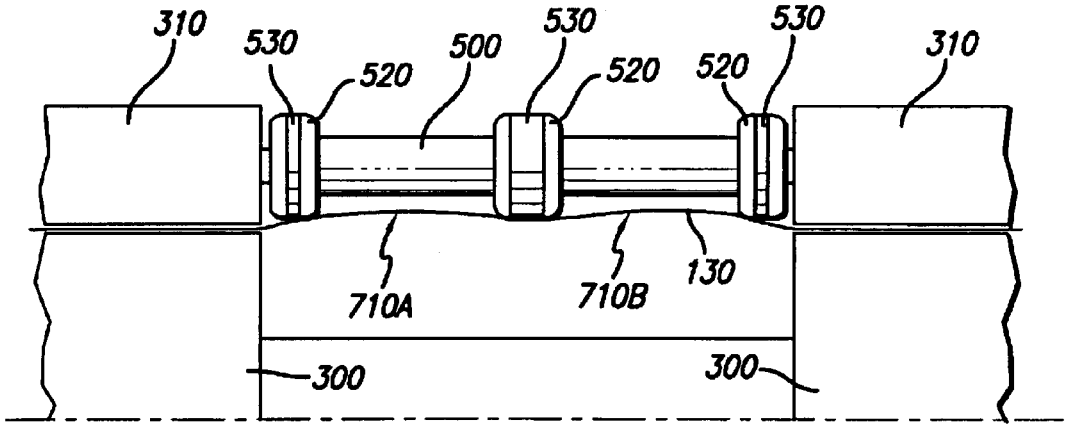
Figure 7C:
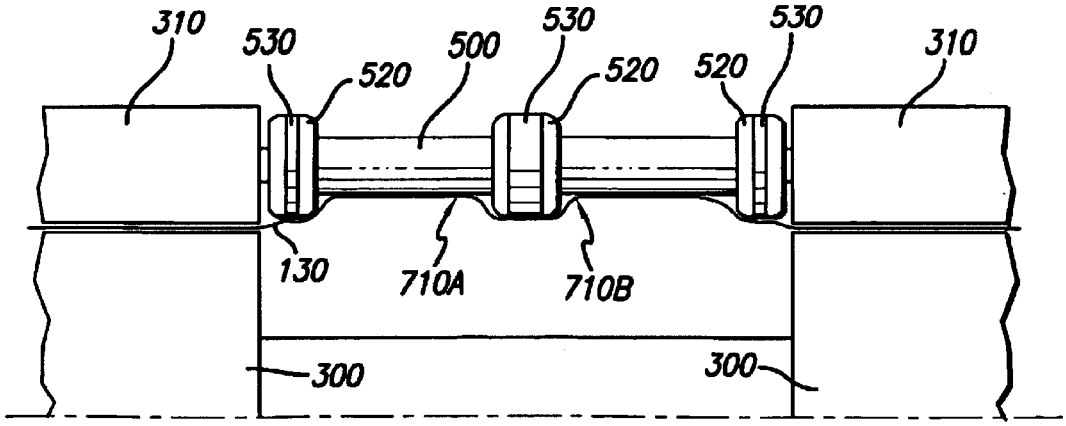

Depending upon the prevailing conditions, such as the quantity of ink being deposited on the print media 130, the size of the print bubbles 710*a* and 710*b* may grow beyond the size shown in FIG. 7*b*. This situation is shown in the FIG. 7*c*. As can be seen from the figure, the media bubbles 710*a* and 710*b* have grown to the extent that the upper surface of the print media 130 now contacts the surface of the central axle 510 of the pinch wheel 500. This situation shows the maximum size of media bubble that may be accommodated by the design of the inter-pinch wheels 500 of the present embodiment. However, even with this size of media bubble, the inter-pinch wheel 500 continues to rotated as the media is fed, thus avoiding damaging the surface of the print media, as has been explained above.

Further Embodiments

As the skilled reader will appreciate, various modifications may be made to the above-described embodiment. The skilled reader will, for example, appreciate that the optimal design, dimensions and number of inter-pinch wheels according to the present invention for use in a given situation will depend upon the design and use of the printer with which they are used. This may be determined experimentally.

Although the above embodiment has been described in terms of use with a pre-cut sheet of print media, the skilled person will appreciate that the problem addressed by the present invention exists also with roll fed print media. Therefore, the present invention may also be used to advantage with roll fed print media.

For example the number of areas of increased radius 520*a–c* may be greater or fewer than the three which are described in the above embodiment. Furthermore, the diameter of the areas of increased radius 520*a–c* may be increased or reduced relative to the radius of the central axle 510, in order to allow a print bubble more or less space into which it might expand, depending upon requirements.

Furthermore, the areas of increased radius 520*a–c* may instead of being formed by solid "wheels" with a continuous tread area, may be formed by a series of closely-arranged ribs or a plurality of closely-arranged raised dots or pimples of circular or any other convenient shape.

Additionally, the manner in which the inter-pinch wheels are mounted may be modified relative to that of the above embodiment. For example, they may be rigidly mounted relative to adjacent pinch wheels, or may even form one continuous structure with one or more adjacent pinch wheels. Alternatively, they may be mounted independently of the adjacent pinch wheels or the pinch wheels system. Thus, the inter-pinch wheels need not be located at the same point on the media feed path as the pinch wheels. For example, they may be located either upstream or downstream of the pinch wheels, in the sense of the normal print media feed direction. In practise, the inter-pinch wheels and or the pinch wheels may be actively driven.

What is claimed is:

1. An ink jet apparatus having a print media feed path and a print media feed assembly, said feed assembly being arranged to feed print media having a width and a length in the direction of said media length along said feed path, said feed assembly including:

a print media drive roller having a rotational axis extending substantially transverse to said feed path;

first and second pinch wheels arranged to rotatably cooperate with said drive roller so as to grip said media therebetween at first and second respective locations spaced apart along said media width; and a roller element arranged to rotate independently of said pinch wheels about a rotational axis substantially parallel to said drive roller rotational axis, the roller element being located at a third location along said media width substantially immediately between end segments of said first and said second pinch wheels, the roller element being arranged to permit a predetermined amount of free displacement of said media toward said roller element in the region of the third location.

2. An apparatus according to claim 1, wherein said feed assembly is arranged to feed said print media such that said media is substantially not entrained about said drive roller.

3. An apparatus according to claim 1, further comprising a printzone, said roller element being located substantially immediately upstream of said printzone.

4. An apparatus according to claim 1, wherein:

said roller element is mounted substantially coaxially with said first and second pinch wheels.

5. An inkjet apparatus having a print media feed path and a print media feed assembly, said feed assembly being arranged to feed print media having a width and a length in the direction of said media length along said feed path; said feed assembly including:

a print media drive roller having a rotational axis extending substantially transverse to said feed path;

first and second pinch wheels arranged to rotatably cooperate with said drive roller so as to grip said media therebetween at first and second respective locations a spaced apart along said media width; and a roller element arranged to rotate about a rotational axis substantially parallel to said drive roller rotational axis, the roller element being located at a third location along said media width substantially between said first and said second locations, the roller element being arranged to permit a predetermined amount of free displacement of said media toward said roller element in the region of the third location;

wherein said roller element includes a media contacting surface disposed around said roller element rotational axis, said media contacting surface having a profile that varies along the length of said rotational axis that is adapted to limit the height of said media to different extents along said media width.

6. An inkjet apparatus having:

a print media feed path and a print media feed assembly, said feed assembly being arranged to feed print media having a width and a length in the direction of said media length along said feed path, said feed assembly including:

a print media drive roller having a rotational axis extending substantially transverse to said feed path;

first and second pinch wheels arranged to rotatably cooperate with said drive roller so as to grip said media therebetween, and being further arranged to grip said media at first and second respective locations spaced apart along said media width; and a roller element being arranged to rotate about a rotational axis substantially parallel to said drive roller rotational axis, the roller element being located at a third location along said media width, said third location being substantially between said first and said second locations, the roller element being arranged to limit the height of said media in the region of the third location, said roller element further including a media contacting surface disposed around said roller element rotational axis, said media contacting surface having a profile that varies along the length of said rotational axis that is adapted to limit the height of said media to different extends along said media width;

wherein said profile forms three zones of greater diameter disposed along said length of said roller element rotational axis, each adjacent said zone of greater diameter being separated by a zone of lesser diameter, said zones of greater diameter being arranged to limit said media height to greater extent than said zones of lesser diameter.

7. An apparatus according to claim 5 or 6, wherein:

said roller element is mounted substantially coaxially with said first and second pinch wheels.

8. An apparatus according to claim 7, wherein:

said first and second pinch wheels respectively comprise first and second stub axles, said roller element being mounted on said first and second stub axles.

9. An apparatus according to claim 8, wherein:

said roller element comprises polycarbonate bearings arranged to receive said stub axles.

10. An apparatus according to claim 8, wherein said roller element is arranged to be mountable as a press fit.

11. An apparatus according to claim 7, wherein said roller element comprises a maximum diameter of substantially the same or smaller than said first and second pinch wheels.

12. An apparatus according to claim 7, wherein:

said roller element is a single, substantially unitary plastic component, substantially homogeneous in internal composition.

13. An apparatus according to claim 12, wherein said roller element is manufactured from a plastics material.

14. An apparatus according to claim 13, wherein said material is a polycarbonate material.

15. An apparatus according to claim 14, wherein:

said material incorporates approximately 20% glass fiber or approximately 15% PTFE.

16. An ink jet apparatus having a print media feed path and a print media feed assembly, said feed assembly being arranged to feed print media having a width and a length in the direction of said media length along said feed path, said feed assembly including:

a print media drive roller having a rotational axis extending substantially transverse to said feed path;

first and second pinch wheels arranged to rotatably cooperate with said drive roller so as to grip said media therebetween at first and second respective locations spaced apart along said media width; and a roller element being arranged to rotate about a rotational axis substantially parallel to said drive roller rotational axis, the roller element being located at a third location along said media width substantially between said first and said second locations, the roller element being arranged to permit a predetermined amount of free displacement of said media toward said roller element in the region of the third location;

wherein said roller element is mounted substantially coaxially with said first and second pinch wheels and comprises stub axles adapted to mount said roller element between said first and second pinch wheels.

17. An apparatus according to claim 16, wherein said roller element is arranged to be mountable as a press fit.

18. The apparatus of claim 16, wherein:

said roller element further including a media-contacting surface disposed around said roller element rotational axis, said media-contacting surface having a profile that varies along the length of said rotational axis that is adapted to limit the height of said media to different extents along said media width.

19. The apparatus of claim 18, wherein:

said profile forms three zones of greater diameter disposed along said length of said roller element rotational axis, each adjacent said zone of greater diameter being separated by a zone of lesser diameter, said zones of greater diameter being arranged to limit said media height to a greater extent than said zones of lesser diameter.

20. An ink jet apparatus having a print media feed path and a print media feed assembly, said feed assembly being arranged to feed print media having a width and a length in the direction of said media length along said feed path, said feed assembly including:

a print media drive roller having a rotational axis extending substantially transverse to said feed path;

first and second pinch wheels arranged to rotatably cooperate with said drive roller so as to grip said media therebetween at first and second respective locations spaced apart along said media width; and a roller element being arranged to rotate independently of said pinch wheels about a rotational axis substantially parallel to said drive roller rotational axis, the roller element being located at a third location along said media width substantially between said first and said second locations, the roller element being arranged to permit a predetermined amount of free displacement of said media toward said roller element in the region of the third location;

wherein said first and second pinch wheels are mounted on respective mounting devices and said roller element is mounted between said respective mounting devices.

21. An apparatus according to claim 20, wherein:

said roller element is arranged to be mounted on stub axles.

22. The apparatus of claim 20, wherein:

said roller element includes a media-contacting surface disposed around said roller element rotational axis, said media-contacting surface having a profile that varies along the length of said rotational axis and is adapted to limit the height of said media to different extents along said media width.

23. The apparatus of claim 22, wherein:

said profile forms three zones of greater diameter disposed along said length of said roller element rotational axis, each adjacent said zone of greater diameter being separated by a zone of lesser diameter, said zones of greater diameter being arranged to limit said media height to a greater extent than said zones of lesser diameter.

24. A feed assembly, for use in an ink jet apparatus that has a print-media feed path for feeding print media having width and length; said feed assembly including:

a print media drive roller having a rotational axis extending substantially transverse to said feed path;

first and second pinch wheels arranged to rotatably cooperate with said drive roller so as to grip said media therebetween at first and second respective locations spaced apart along said media width; and a roller element arranged to rotate independently of said pinch wheels about a rotational axis substantially parallel to said drive roller rotational axis, the roller element being located at a third location along said media width substantially between said first and siad second locations, the roller element being arranged to permit a predetermined amount of free displacement of said media toward said roller element in the region of the third location;

wherein said roller element is mounted substantially coaxially with said first and second pinch wheels; and wherein said roller element includes a media contacting surface disposed around said roller element rotational axis, said media contacting surface having a profile that varies along the length of said rotational axis that is adapted to limit the height of said media to different extents along said media width.

25. The feed assembly of claim 24, wherein:

said roller element comprises stub axles adapted to mount said roller element between said first and second pinch wheels.

26. An inkjet apparatus comprising:

a printzone and a media feed assembly arranged to feed a sheet of print media into said printzone;

said assembly comprising a drive roller and first and second pinch wheels arranged to rotatably cooperate with said drive roller so as to grip said media therebetween at respective first and second locations spatially separated along the longitudinal axis of said drive roller; and means for controlling print-media bubble formation and removing print-media bubbles that begin to form; said controlling and removing means comprising a roller element located substantially immediately upstream of said printzone and substantially immediately between end segments of said first and second pinch wheels, and arranged to limit the displacement of the media in the area substantially immediately between end segments of said first and second pinch wheels in a direction perpendicular to the longitudinal axis of said drive roller;

said roller element having at least longitudinal portions arranged so as to not contact the media when the media is not thus displaced.

27. An inkjet apparatus according to claim 26, further comprising:

one or more printheads arranged to eject ink droplets onto the print media located in said printzone.

28. An inkjet apparatus according to claim 26 or claim 21, wherein said roller element is adapted to limit the media to a displacement of at least 0.4 mm.

29. An apparatus according to claim 26, wherein said feed assembly is arranged to feed said print media such that said media is substantially not entrained about said drive roller.

30. An apparatus according to claim 26, wherein said roller element is arranged to rotate independently of said pinch wheels.

31. An inkjet apparatus comprising:

a printzone and a media feed assembly arranged to feed a sheet of print media into said printzone;

said assembly comprising a drive roller and first and second pinch wheels arranged to rotatably cooperate with said drive roller so as to grip said media therebetween at respective first and second locations spatially separated along the longitudinal axis of said drive roller; and a roller element adapted to rotate independently of said pinch wheels and located substantially immediately between end segments of said first and second pinch wheels, so as to permit up to a predetermined degree of free displacement of the media, in the area substantially immediately between the end segments of said first and second pinch wheels, in a direction perpendicular to and away from the longitudinal axis of said drive roller.

32. An inkjet apparatus according to claim 31, further comprising:

one or more printheads arranged to eject ink droplets onto the print media located in said printzone.

33. An inkjet apparatus according to claim 31 or claim 24, wherein:

said roller element is adapted to permit a predetermined degree of displacement of approximately 0.4 mm or more.

34. A printer comprising:

a printhead arranged to eject ink droplets onto print media located in a printzone, a media path and a media feed assembly;

said feed assembly being arranged to feed a media sheet to said printzone, said feed assembly including:

a drive roller having a rotational axis extending substantially across said feed path;

first and second pinch wheels located substantially immediately upstream of said printzone and arranged to rotatably cooperate with said drive roller so as to grip said media therebetween at first and second respective locations spaced apart along the longitudinal axis of said drive roller; and a roller element adapted and located immediately between end segments of said first and second pinch wheels, so as to permit up to a predetermined degree of free displacement of the media in the area substantially between the end segments of said first and second pinch wheels in a direction perpendicular the longitudinal axis of said drive roller, in order to regulate the height of print media cockle entering said printzone.

35. A printer according to claim 34, wherein said feed assembly is arranged to feed said print media such that said media is substantially not entrained about said drive roller.

36. A printer according to claim 34, wherein said roller element is arranged to rotate independently of said pinch wheels.

37. An inkjet printer having:

a media feed assembly comprising a drive roller and first and second pinch wheels arranged to grip a media sheet against said drive roller at first and second locations respectively along the longitudinal axis of said drive roller; and a roller means arranged immediately between end segments of said first and second pinch wheels to permit a predetermined degree of free displacement of said media in a direction perpendicular to the longitudinal axis of said drive roller in the area substantially immediately between the end segments of said first and second pinch wheels, said roller means being arranged to rotate independently of said pinch wheels and thereby to limit further displacement of said media in said direction without scratching said media.

38. A printer according to claim 37, wherein:

said print feed assembly is arranged to feed said print media such that said media is substantially not entrained about said drive roller.

39. A printer according to claim 37, further comprising:

a printzone, said roller means being located substantially immediately upstream of said printzone.

40. An inkjet apparatus comprising:

a media feed assembly arranged to feed a sheet of print media into a printzone;

said assembly comprising a drive roller and first and second pinch wheels arranged to rotatably cooperate with said drive roller at first and second respective locations along the longitudinal axis of said drive roller so as to grip said media therebetween, said assembly being arranged such that said media is substantially not entrained about said drive roller; and a roller element arranged substantially immediately between end segments of said first and second pinch wheels, to permit up to a predetermined degree of displacement of the media due to wet cockle in the area substantially immediately between the end segments of said first and second pinch wheels in a direction away from the longitudinal axis of said drive roller.

41. An apparatus according to claim 40, wherein said roller element is arranged to rotate independently of said pinch wheels.

42. An apparatus according to claim 40, wherein said roller element is located substantially immediately upstream of said printzone.

* * * * *